US008969747B2

(12) United States Patent
Chou

(10) Patent No.: US 8,969,747 B2
(45) Date of Patent: Mar. 3, 2015

(54) SANDWICH-TYPE TILT SWITCH

(71) Applicant: Tien-Ming Chou, Taichung (TW)

(72) Inventor: Tien-Ming Chou, Taichung (TW)

( * ) Notice: Subject to any disclaimer, the term of this patent is extended or adjusted under 35 U.S.C. 154(b) by 180 days.

(21) Appl. No.: 13/845,887

(22) Filed: Mar. 18, 2013

(65) Prior Publication Data

US 2014/0262704 A1 Sep. 18, 2014

(51) Int. Cl.
*H01H 35/02* (2006.01)

(52) U.S. Cl.
CPC ..... *H01H 35/02* (2013.01)
USPC ..... 200/61.52

(58) Field of Classification Search
USPC ..... 200/61.52, 61.45 R
IPC ..... H01H 35/02,35/025
See application file for complete search history.

(56) References Cited

U.S. PATENT DOCUMENTS

| | | | | |
|---|---|---|---|---|
| 4,751,353 | A * | 6/1988 | Stephens | 200/277 |
| 6,448,516 | B1 * | 9/2002 | Chiang | 200/61.45 R |
| 2003/0196878 | A1 * | 10/2003 | Wagatsuma et al. | 200/61.45 R |
| 2012/0111702 | A1 * | 5/2012 | Wang et al. | 200/61.52 |
| 2014/0034460 | A1 * | 2/2014 | Chou | 200/61.52 |
| 2014/0231231 | A1 * | 8/2014 | Chou | 200/61.52 |

FOREIGN PATENT DOCUMENTS

TW M409517 U1 8/2011

* cited by examiner

*Primary Examiner* — Vanessa Girardi
(74) *Attorney, Agent, or Firm* — The Webb Law Firm

(57) ABSTRACT

A tilt switch includes an insulated housing with two housing halves cooperatively defining an accommodation chamber and a plurality of positioning grooves formed in a surface of at least one housing half around the accommodation chamber. A plurality of conductive terminals are sandwiched between the housing halves. Each conductive terminal has a plate member positioned in a respective positioning groove, and a contact portion extending into the accommodation chamber. A conductive body is disposed in the accommodation chamber and is movable between a closed circuit state that bridges the contact portions of at least two conductive terminals and an open circuit state that does not bridge the contact portions of any two conductive terminals.

11 Claims, 8 Drawing Sheets

SANDWICH-TYPE TILT SWITCH

BACKGROUND OF THE INVENTION

1. Field of the Invention

The invention relates to a tilt switch, more particularly to a sandwich-type tilt switch that uses angular changes to open or close a circuit.

2. Description of the Related Art

Referring to FIGS. 1 and 2, a tilt switch 1, as disclosed in Taiwanese Patent No. M409517, includes an insulated housing 11, a cover 12 that mates with the insulated housing 11 and that cooperates with the same to define an accommodation chamber 10, four terminals 13, and a ball 14 disposed in the accommodation chamber 10. The insulated housing 11 has a plurality of engaging pegs 111 projecting from an upper surface thereof, and a plurality of accommodating grooves 112 and a plurality of pinholes 113 formed in a lower wall of the insulated housing 11 that allow spatial communication between the accommodation chamber 10 and an exterior of the insulated housing 11. The cover 12 has a plurality of openings 121 for extension of the respective engaging pegs 111 therethrough. Each of the terminals 13 has a contact portion 131 that extends through a respective accommodating groove 112 into the accommodation chamber 10, and a welding portion 132 exposed to the exterior of the insulated housing 11.

This structure allows the ball 14 to roll between a closed circuit state, in which the ball 14 simultaneously bridges any two of the contact portions 131, and an open circuit state, in which the ball does not simultaneously bridge two of the contact portions 131. Hence, an ON/OFF effect of the tilt switch 1 can be achieved.

The pin holes 113 respectively accommodating a plurality of positioning pegs 15 are formed in the lower wall of the insulated housing 11 of the tilt switch 1 when forming the insulated housing 11 by injection molding. To facilitate the injection molding of the insulated housing 11, the positioning pins 15 are disposed to respectively abut against the terminals 13 to stabilize the terminals 13. However, gaps that permit penetration of moisture are formed between the pin holes 113 and the respective receiving grooves 112. Further, because the positioning pins 15 merely abut against the terminals 13 and do not secure the positions of the terminals 13, the terminals 13 may easily shift during the injection molding process, thereby causing formation anomalies that may reduce assembly precision.

SUMMARY OF THE INVENTION

Therefore, the object of the present invention is to provide a sandwich-type tilt switch with enhanced stability and positioning effect.

Accordingly, a tilt switch of the present invention comprises an insulated housing, a plurality of conductive terminals, and a conductive body. The insulated housing includes two housing halves that cooperatively define an accommodation chamber and that have opposed joined surfaces joined together around said accommodation chamber, and a plurality of positioning grooves formed in the joined surface of at least one of the housing halves around the accommodation chamber. The conductive terminals are sandwiched between the housing halves. Each of the conductive terminals has a plate member positioned in a respective one of the positioning grooves, a contact portion extending from the plate member into the accommodation chamber, and a conducting portion exposed to an exterior of the insulated housing. The plate member has a plate body and two connecting pins formed on different sides of the plate body. One of the connecting pins extends from one side of the plate body and is connected to the conducting portion. The conductive body is disposed in the accommodation chamber and is movable between a closed circuit state, in which the conductive body bridges the contact portions of at least two of the conductive terminals, and an open circuit state, in which the conductive body does not bridge the contact portions of any two of the conductive terminals.

The beneficial effect of the present invention resides in that by using the positioning grooves to restrict the positions of the respective conductive terminals, the positioning effect of the conductive terminals before assembly and the stability of the conductive terminals after assembly can be enhanced, thereby facilitating the assembly process and enhancing assembly precision.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
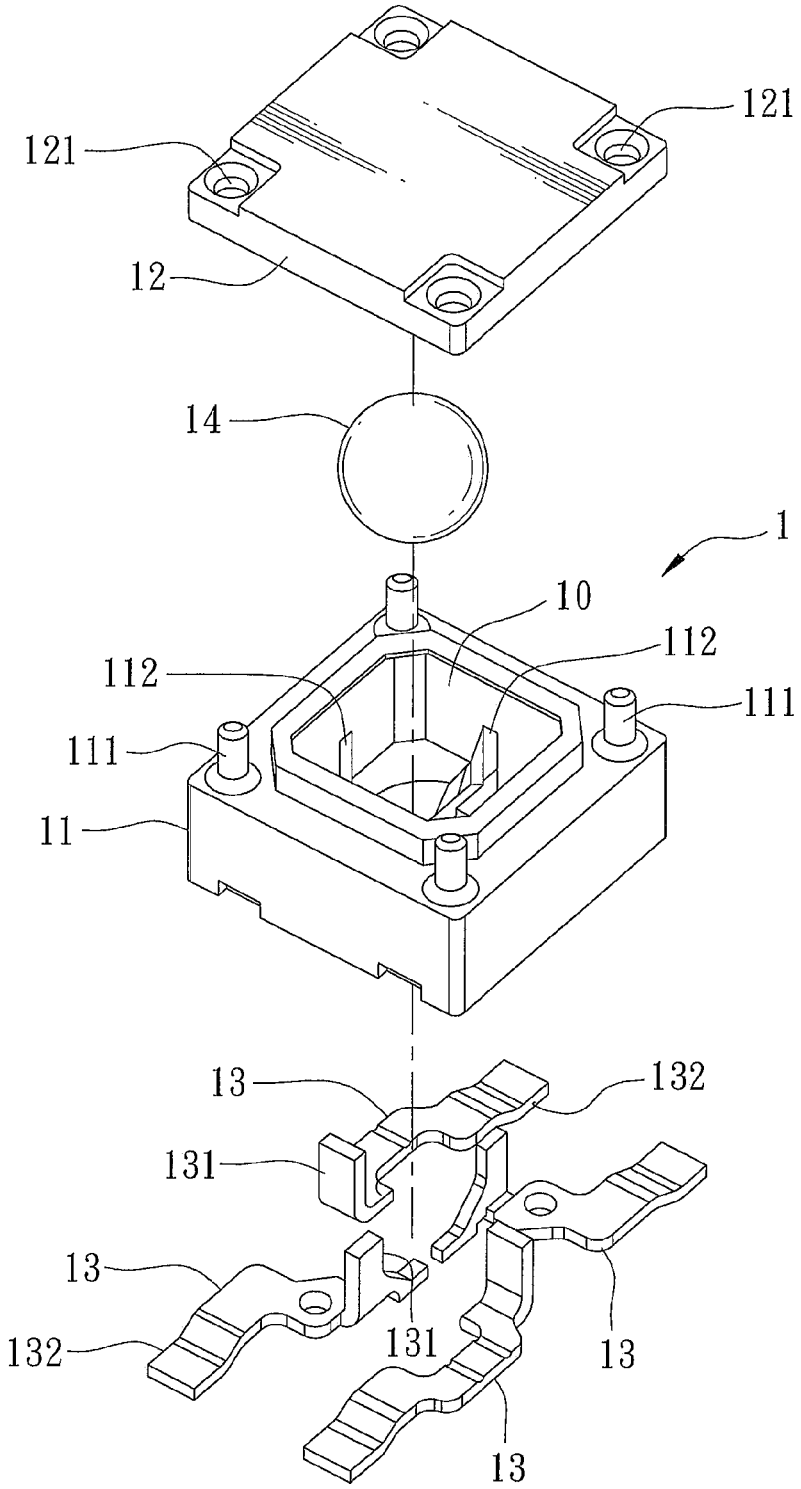
FIG. 1 PRIOR ART
FIG. 1 is an exploded perspective view of a tilt switch disclosed in Taiwanese Patent No. M409517.

Before the present invention is described in greater detail, it should be noted that like elements are denoted by the same reference numerals throughout the disclosure.

Figure 3:
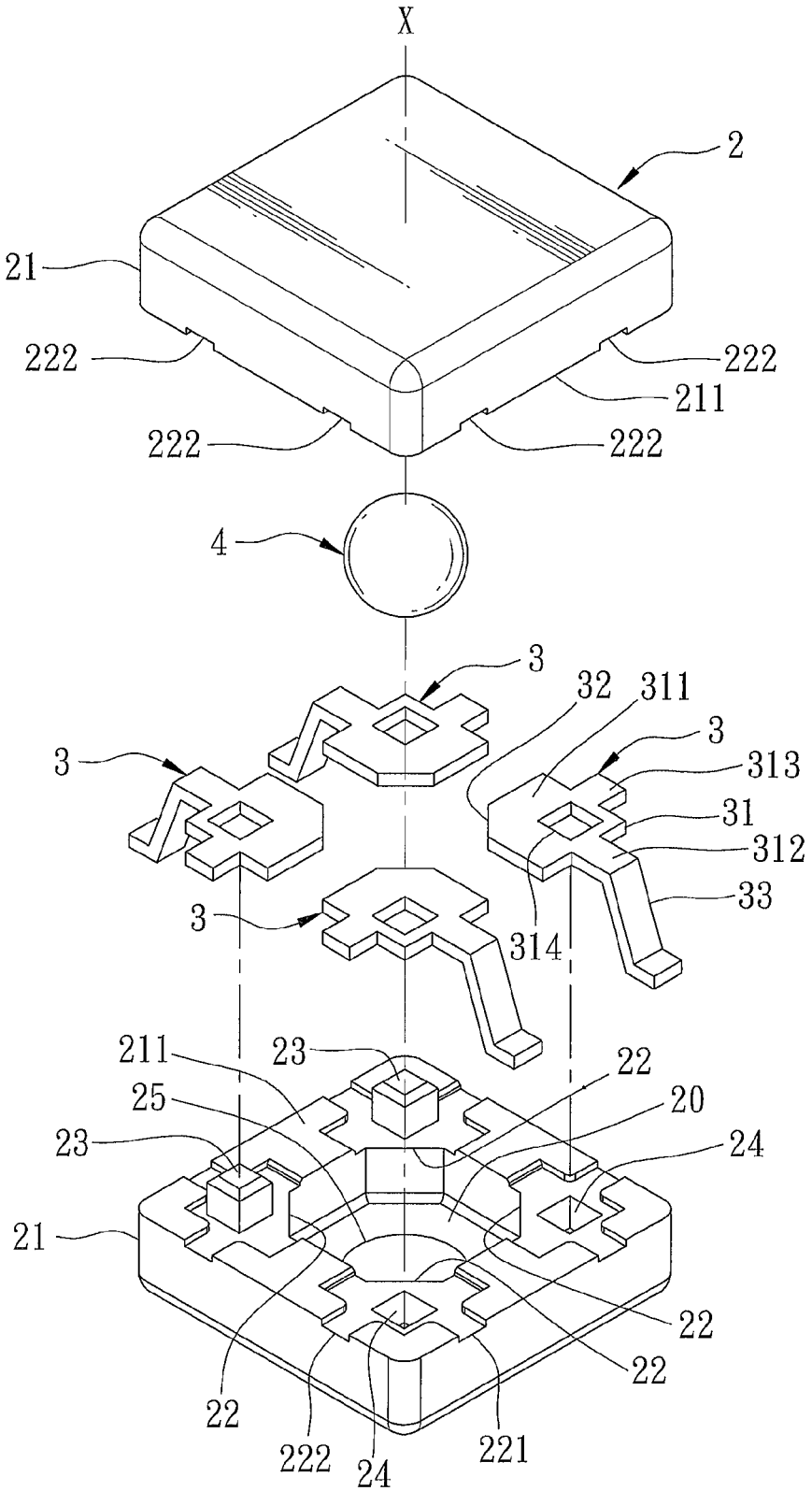
FIG. 3 is an exploded perspective view of the first preferred embodiment of a tilt switch according to the present invention.
Figure 4:
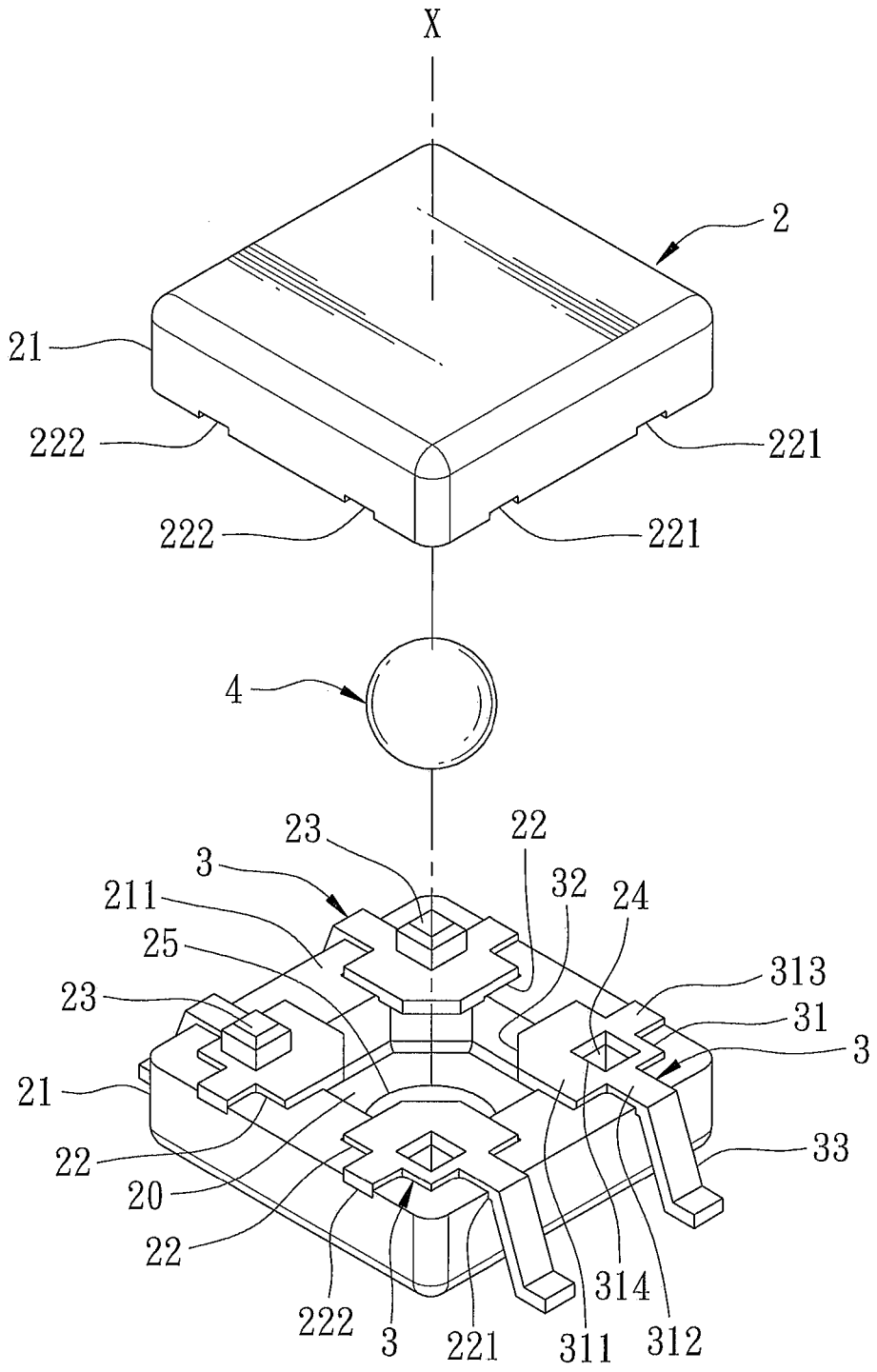
FIG. 4 is a view similar to FIG. 3, but with a plurality of conductive terminals being respectively disposed in positioning grooves of a housing half.
Figure 5:
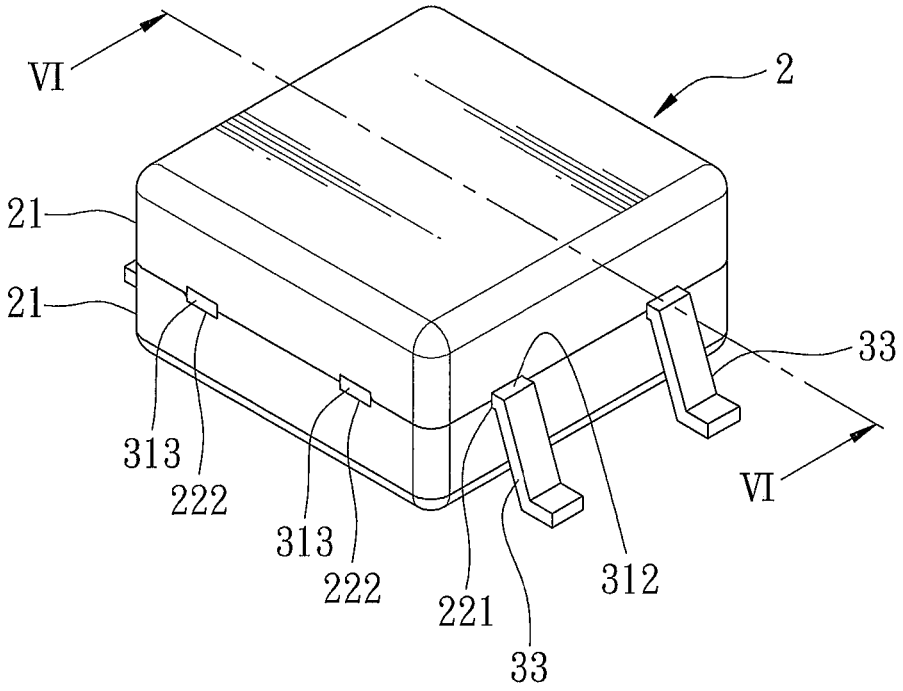
FIG. 5 is a perspective view of the first preferred embodiment in an assembled state.

Referring to FIGS. 3, 4, and 5, the first preferred embodiment of a sandwich-type tilt switch according to the present invention comprises an insulated housing 2, a plurality of conductive terminals 3, and a conductive body 4.

The insulated housing 2 includes two housing halves 21 that cooperatively define an accommodation chamber 20 and that have opposite joined surfaces 211 joined together along an axis (X) and around the accommodation chamber 20, a plurality of positioning grooves 22, a plurality of protruding portions 23, a plurality of recess portions 24, and two concavities 25. In this embodiment, each of the housing halves 21 has an inner surface 212 that cooperates with the inner surface 212 of the other housing half 21 to form the accommodation chamber 20, and includes four positioning grooves 22 formed in the joined surface 211 of a respective one of the housing halves 21 around the accommodation chamber 20, and two protruding portions 23 and two recess portions 24 that are formed in the joined surface 211 of the respective housing half 21. Each of the concavities 25 is formed in the inner surface 212 of the respective housing half 21. Each of the positioning grooves 22 has two openings 221, 222 that are formed in different sides of the corresponding housing half 21 and that are in spatial communication with an exterior of the insulated housing 2. The protruding portions 23 and the recess portions 24 of one of the housing halves 21 are configured to respectively mate with the recess portions 24 and the protruding portions 23 of the other housing half 21. Hence, the two housing halves 21 are mated together as a unitary body through interengagement of the recess portions 24 and the protruding portions 23. In an alternative embodiment, one of the housing halves 21 may include four protruding portions 23, while the other housing half 21 may include four recess portions 24 to respectively mate with the protruding portion 23. The protruding portions 23 and the recess portion 24 of each housing half 21 are located within an area of the respective positioning grooves 22. Each of the protruding portions 23 and the recess portions 24 has a polygonal profile. Each of the protruding portions 23 takes the form of a rectangular column in this embodiment. Alternatively, each protruding portion 23 may take the form of a rib or a projection. Each of the recess portions 24 takes the form of a rectangular groove in this embodiment. Alternatively, each recess portion 24 may take the form of a hole or a notch.

The conductive terminals 3 are sandwiched between the two housing halves 21. Each of the conductive terminals 3 has a plate member 31 positioned in a respective positioning groove 22 in one of the housing halves 21, a contact portion 32 extending from the plate member 31 into the accommodation chamber 20, and a conducting portion 33 exposed to the exterior of the insulated housing 2. The plate member 31 has a plate body 311, two connecting pins 312, 313 extending from different sides of the plate body 311, and a through hole 314 formed in the plate body 311 for extension of the respective protruding portion 23 therethrough. The plate body 311 of each plate member 31 is received in the respective positioning groove 22 such that the connecting pins 312, 313 of each plate member 31 are respectively exposed through the openings 221, 222 in the corresponding positioning groove 22. In this embodiment, the through hole 314 is a rectangular hole that penetrates the plate body 311 in a direction parallel to the axis (X). The conducting portion 33 of each conductive terminal 3 is connected to the connecting pin 312 of a respective plate member 31.

The conductive body 4 is received in the accommodation chamber 20 and is movable between a closed circuit state, in which the conductive body 4 bridges the contact portions 32 of at least two of the conductive terminals 3, and an open circuit state, in which the conductive body 4 does not bridge the contact portions 32 of any two of the conductive terminals 3.

During assembly, the plate member 31 of each conductive terminal 3 is merely pressed into a respective positioning groove 22 in one of the housing halves 21, and the plate member 31 and the corresponding connecting pins 312, 312 can be positioned in the respective positioning groove 22 and the corresponding openings 221, 222. As such, any offsetting of the conductive terminals 3 can be prevented, thereby stabilizing the conductive terminals 3 on the joined surface 211 of the one of the housing halves 21. When the two housing halves 21 are joined together, not only can the two housing halves 21 be joined together as a unitary body through the interengagement of the protruding portions 23 and the recess portions 24, the protruding portions 23 of the housing halves 21 can also pass through the through holes 314 in the respective conductive terminals 3, thereby sandwiching the conductive terminals 3 between the joined housing halves 21.

It is worth mentioning that a plurality of conductive terminals 3 may be manufactured simultaneously by pressing a blank strip such that the connecting pins 313 join the plurality of conductive terminals 3. This allows the simultaneous pressing of a plurality of conductive terminals 3 with a plurality of housing halves 21, thereby increasing the speed of assembly.

Figure 6:
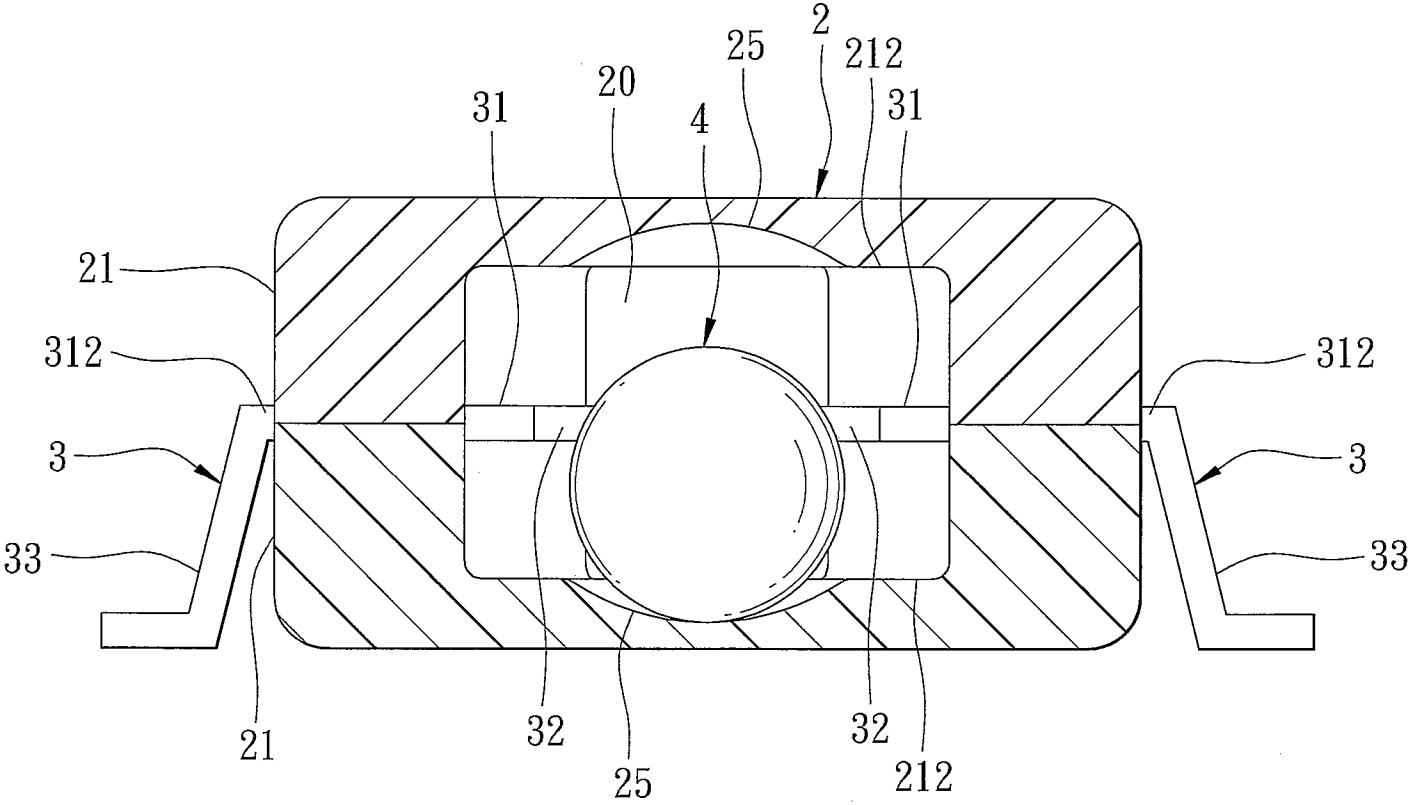
FIG. 6 is a sectional view of the first preferred embodiment taken along line VI-VI of FIG. 5.

With reference to FIGS. 4 and 6, at a default position, the conductive body 3 falls into the concavity 25 and is located in the open circuit state. At this time, the conductive body 4 does not contact any of the contact portions 32 of the conductive terminals 3, and the tilt switch is at an "OFF" state.

Figure 7:
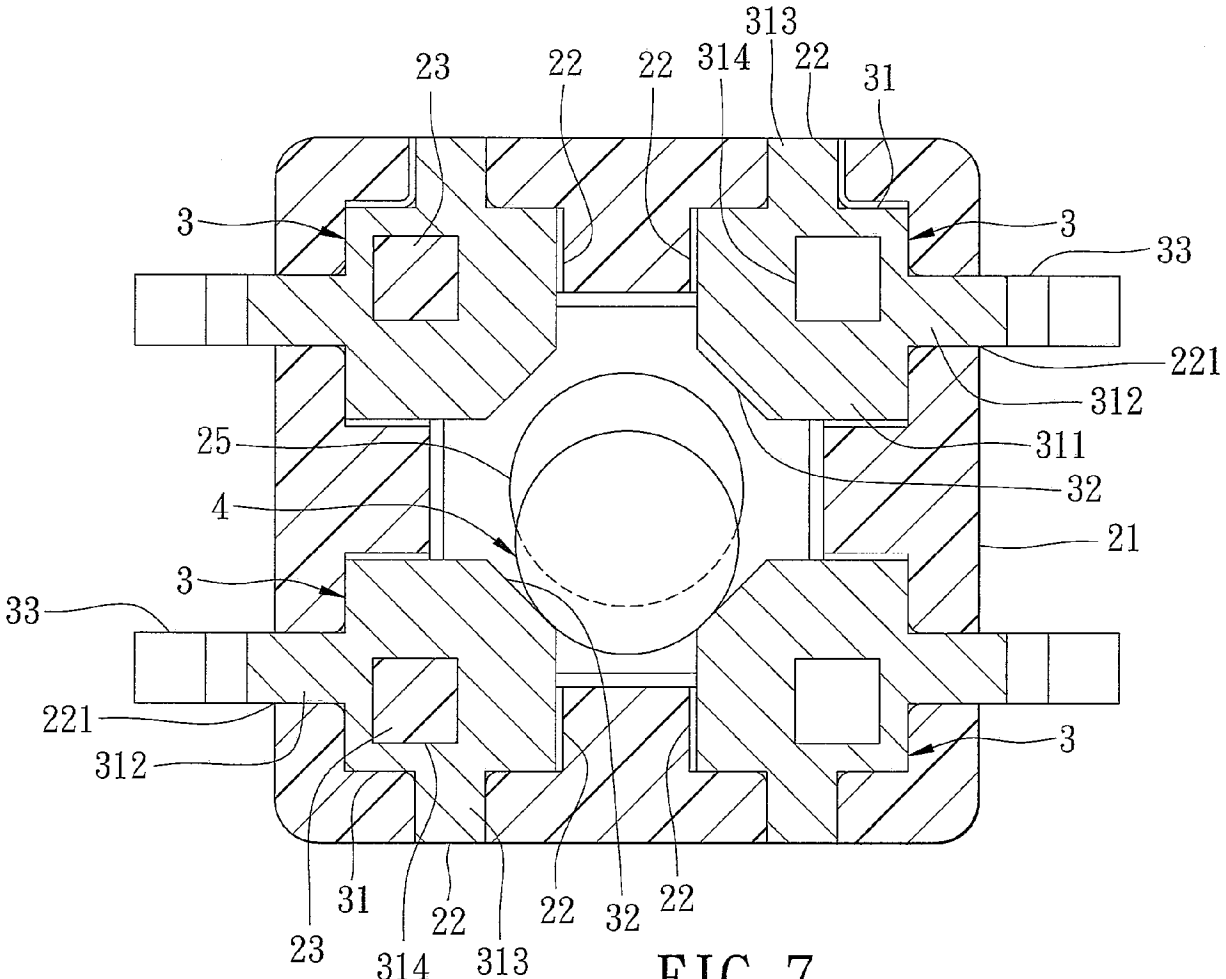
FIG. 7 is a sectional top view of the first preferred embodiment, illustrating a conductive body in contact with contact portions of two conductive terminals.

With reference to FIGS. 4 and 7, when the insulated housing 2 is tilted due to an external force, the conductive body 3 will roll within the accommodation chamber 4 based on the direction of the external force into the closed circuit state, in which the conductive body 4 contacts and bridges the contact portions 32 of two of the conductive terminals 3, thereby shifting the tilt switch from an "OFF" state to an "ON" state. Thus, ON/OFF effect of the tilt switch can be achieved.

Figure 8:
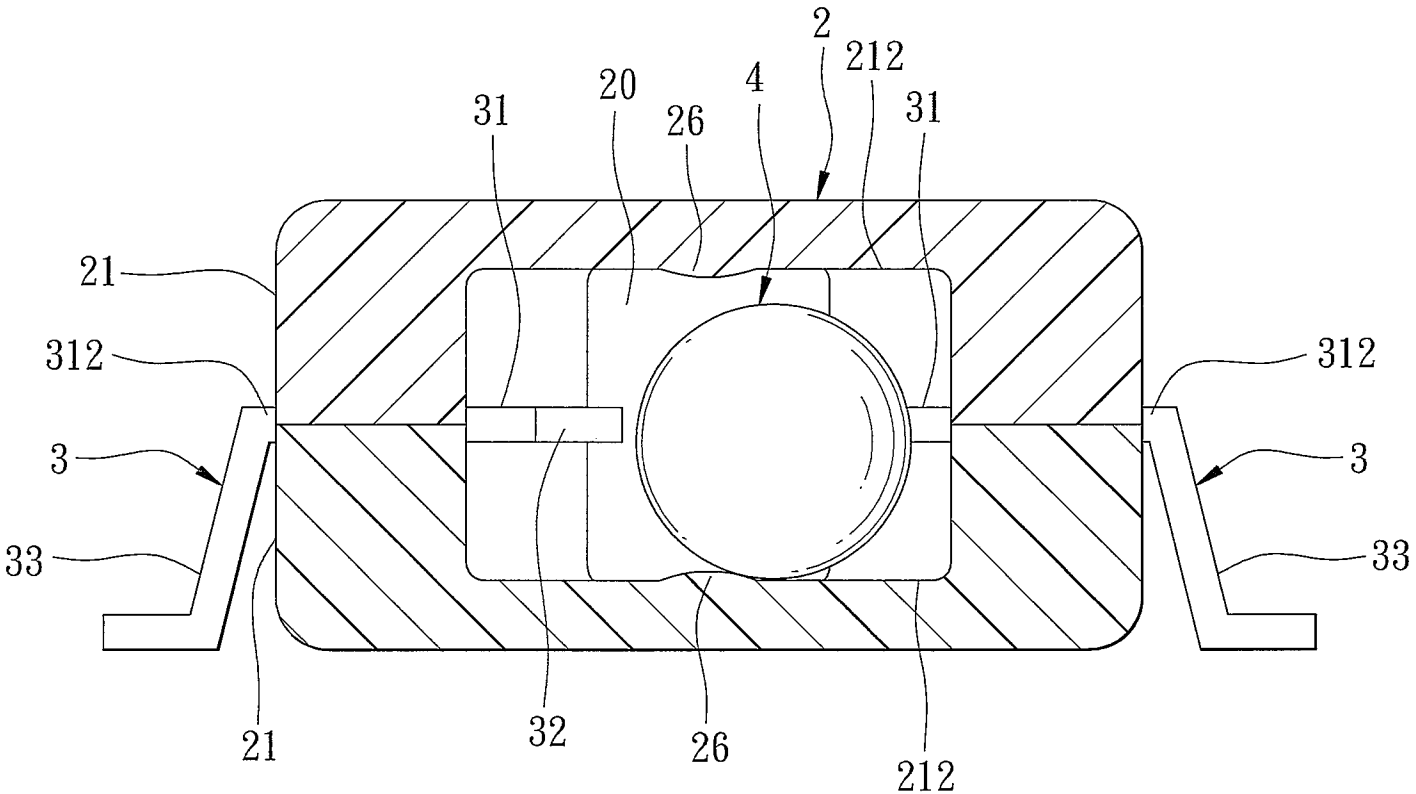
FIG. 8 is a sectional view of a tilt switch according to the second preferred embodiment of the present invention.

With reference to FIG. 8, the second preferred embodiment of a tilt switch according to the present invention is shown to be substantially similar to the first preferred embodiment. However, in this embodiment, the insulated housing 2 includes two bulge portions 26 in place of the concavities 25 (see FIG. 6). Each of the bulge portions 26 protrudes from the inner surface 212 of the respective housing half 21 toward the accommodation chamber 20. In the absence of an external force, the conductive body 4 is pushed by the bulge portion 26 to move to the closed circuit state, in which the conductive body 4 contacts and bridges the contact portions 32 of two of the conductive terminals 3. When the insulated housing 2 is vibrated or is tilted due to an external force, the conductive body 4 is moved to the open circuit state, in which the conductive body 4 will not contact any of the contact portions 32 of the conductive terminals 3.

Figure 2:
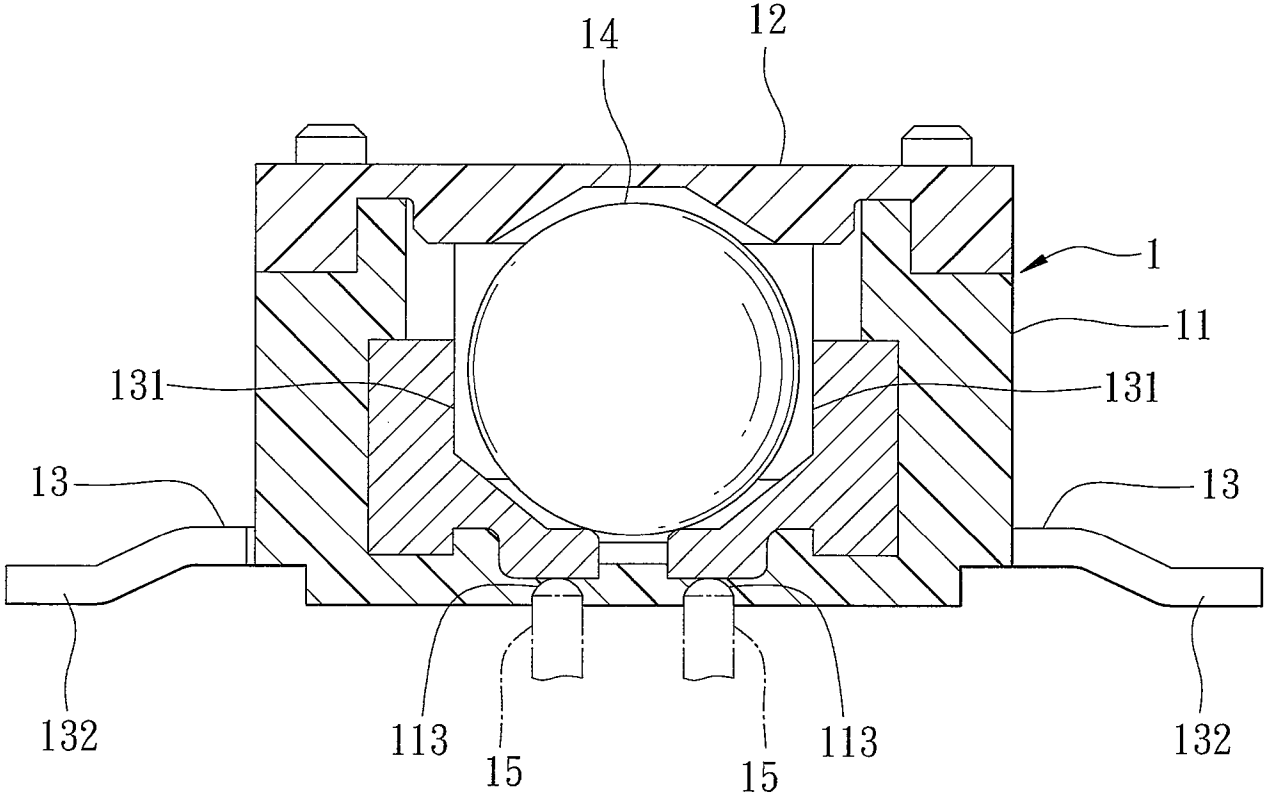
FIG. 2 PRIOR ART
FIG. 2 is a sectional view of the tilt switch of FIG. 1 in an assembled state.

In sum, because the conductive terminals 3 are sandwiched between the housing halves 21 of the insulated housing 2, the insulated housing 2 of the present invention improves upon the prior art by negating the need for additional openings or positioning pins 15 (see FIG. 2). This invention only needs to use the protruding portions 23 and the recess portions 24 to limit the position of the conductive terminals 3, and the positioning effect of the conductive terminals 3 prior to assembly and the stability of the conductive terminals 3 after assembly can thus be enhanced, thereby facilitating the assembly process and enhancing assembly precision.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A tilt switch comprising:

an insulated housing including two housing halves that cooperatively define an accommodation chamber and that have opposed joined surfaces joined together around said accommodation chamber, and a plurality of positioning grooves formed in said joined surface of at least one of said housing halves around said accommodation chamber;

a plurality of conductive terminals sandwiched between said housing halves, each of said conductive terminals having a plate member positioned in a respective one of said positioning grooves, a contact portion extending from said plate member into said accommodation chamber, and a conducting portion exposed to an exterior of said insulated housing, said plate member having a plate body and two connecting pins extending from different sides of said plate body, one of said connecting pins extending from one side of said plate body and connected to said conducting portion; and a conductive body disposed in said accommodation chamber and movable between a closed circuit state, in which said conductive body bridges said contact portions of at least two of said conductive terminals, and an open circuit state, in which said conductive body does not bridge said contact portions of any two of said conductive terminals.

2. The tilt switch as claimed in claim 1, wherein said insulated housing further has a concavity formed in an inner surface of at least one of said housing halves, wherein, when said conductive body falls into said concavity in the absence of an external force, said conductive body is in said open circuit state.

3. The tilt switch as claimed in claim 1, wherein each of said positioning grooves has an opening that is formed in one side of said insulated housing to expose one of said connecting pins of a corresponding said conductive terminal.

4. The tilt switch as claimed in claim 1, wherein each of said housing halves further has a plurality of protruding portions and a plurality of recess portions formed in said joined surface, said two housing halves being mated together as a unitary body through interengagement of said recess portions and said protruding portions.

5. The tilt switch as claimed in claim 4, wherein each of said protruding portions and a respective one of said recess portions are located within an area of a corresponding one of said positioning grooves.

6. The tilt switch as claimed in claim 1, wherein said insulated housing further has a bulge portion protruding from an inner surface of at least one of said housing halves toward said accommodation chamber, said conductive body being pushed by said bulge portion to move to said closed circuit state in the absence of an external force.

7. The tilt switch as claimed in claim 6, wherein each of said positioning grooves further has another opening that is formed in another side of said insulated housing to expose the other one of said connecting pins of the corresponding said conductive terminal.

8. The tilt switch as claimed in claim 1, wherein said insulated housing further includes a plurality of protruding portions and a plurality of recess portions, said protruding portions being formed on said joined surface of one of said housing halves, said recess portions being formed on said joined surface of the other one of said housing halves to mate with said protruding portions, respectively.

9. The tilt switch as claimed in claim 8, wherein each of said recess portions takes the form of a hole, a notch, or a groove, and each of said protruding portions takes the form of a column, a rib, or a projection.

10. The tilt switch as claimed in claim 8, wherein each of said protruding portions and a respective one of said recess portions are located within an area of a corresponding one of said positioning grooves, said plate body of said plate member of each of said conductive terminals being formed with a through hole for extension of a respective one of said protruding portions therethrough.

11. The tilt switch as claimed in claim 8, wherein each of said protruding portions and said recess portions has a polygonal profile.

* * * * *